US008485072B2

(12) United States Patent
Swing

(10) Patent No.: US 8,485,072 B2
(45) Date of Patent: Jul. 16, 2013

(54) QUASI OPEN-END WRENCH

(76) Inventor: Alan Hamilton Swing, Shady Side, MD (US)

( * ) Notice: Subject to any disclaimer, the term of this patent is extended or adjusted under 35 U.S.C. 154(b) by 214 days.

(21) Appl. No.: 13/135,010

(22) Filed: Jun. 23, 2011

(65) Prior Publication Data

US 2012/0325059 A1 Dec. 27, 2012

(51) Int. Cl.
*B25B 13/02* (2006.01)
*B25B 13/08* (2006.01)

(52) U.S. Cl.
USPC ..... 81/125.1; 81/119

(58) Field of Classification Search
USPC ..... 81/125.1, 176.1, 119
See application file for complete search history.

(56) References Cited

U.S. PATENT DOCUMENTS 1,400,285 A * 12/1921 Hart ..... 81/125.1
1,626,809 A * 5/1927 Gillett ..... 81/125.1
1,793,714 A * 2/1931 Newberg ..... 81/125.1
2,652,735 A * 9/1953 Wilder ..... 81/119
3,447,405 A * 6/1969 Lennon et al. ..... 81/119
3,850,057 A * 11/1974 Evans ..... 81/119
3,881,377 A * 5/1975 Evans et al. ..... 81/186
3,921,476 A * 11/1975 Evans ..... 81/119
5,148,726 A * 9/1992 Huebschen et al. ..... 81/119
5,172,614 A * 12/1992 Monnet et al. ..... 81/119
5,307,713 A * 5/1994 White ..... 81/180.1
6,009,778 A * 1/2000 Hsieh ..... 81/119
7,156,000 B2 * 1/2007 Wroblewski ..... 81/125.1

* cited by examiner

*Primary Examiner* — David B Thomas

(57) ABSTRACT

An improved open end wrench having wrench heads at both ends of a shank whereon both wrench heads have arcuate surfaces and backup jaws coplanar with a common torqueing jaw whereby the torqueing jaw is a machined surface of the wrench shank that extends into the wrench heads and is terminated at reliefs at a depth less than half the thickness of the shank, at the intersection of the arcuate surfaces and said torqueing jaw, therein, when excessive torque is applied the relief tends to close whereby the backup jaw and torqueing jaw become nonplanar to each other, therefore wedging the polygonal fastener being worked.

1 Claim, 3 Drawing Sheets

QUASI OPEN-END WRENCH

REFERENCES CITED

| U.S. PATENT DOCUMENTS | | |
|---|---|---|
| 1,400,285 | December 1921 | Hart William Elijah |
| 5,148,726 | September 1992 | Huevschen |
| 6,009,778 | January 2000 | Hsieh |
| 5,307,713 | May 1994 | White |
| 5,172,614 | December 1992 | Monnet |
| 1,793,714 | April 1928 | E. Newberg |
| 3,447,405 | September 1967 | Lennon Et Al |
| 1,626,809 | December 1925 | Gillett |
| 2,652,735 | March 1949 | Wilder |
| 3,850,057 | November 1974 | Evans |
| 3,881,377 | May 1975 | Evans |
| 3,921,476 | November 1975 | Evans |
| 7,156,000 | January 2007 | Wroblewski, Lucien J |

BACKGROUND OF THE INVENTION

This invention relates to typical open end wrenches with fixed heads thereby consisting of arcuate throats interconnecting planar jaws and specifically to the tendency of the wrench to slip off and/or round polygonal fasteners when torque is applied, insofar, when the torque applied isn'table to overcome the resistance of a polygonal fastener, the jaws of said wrench tend to spread apart rounding the fastener. In other cases the user tries to overcome the resistance of the polygonal fastener by unwittingly applying pressure on the shank in a straight line instead of rotational, thus pulling/pushing the wrench off the fastener. There have been many attempts to remedy these conditions. For example;

U.S. Pat. No. 7,156,000 deals specifically with a wrench to be used on electrical conduit connectors whereby an integral part of the wrench is an engagement tab fabricated by necessity of a relief that also allows the user to visualize the engagement of the engagement tab with the shoulder of the connector lock nut.

U.S. Pat. No. 5,307,713 relates to an open end wrench incorporating a protrusion on top of the wrench head to keep the wrench in contact with the fastener while repositioning the wrench, but does not address the problem of slipping off or rounding the fastener.

U.S. Pat. Nos. 5,148,726, and 6,009,778, approach the problem by machining knurl roughness to the jaws of open end wrenches to provide greater gripping capability.

U.S. Pat. Nos. 2,652,735, 3,921,476, and 3,881,377 also approach the problem by machining ridges to the jaws of open end wrenches along with the ability of said wrenches to ratchet.

U.S. Pat. No. 3,850,057 discloses an open end wrench that has the ability to ratchet while gripping a hexagonal fastener on five sides.

U.S. Pat. No. 1,626,809 designates an open end wrench having "V" shaped notches machined on the inside perimeter of its jaws to receive opposite angles of a nut or bolt head when the latter is arranged with its angular diameter transverse of the socket.

U.S. Pat. No. 3,447,405 refers to a wrench specifically used to grip fittings on fluid lines without crimping the lines by virtue of a ball detent in one of the wrenches jaws.

U.S. Pat. Nos. 1,793,714, and 5,172,614 are open end wrenches specifically to provide economy in manufacturing and comport to users without addressing the problem of slipping off or rounding the fastener.

U.S. Pat. No. 1,400,285 describe the physical shape of a fixed head wrench specifically for engaging with stuffing boxes on oil rig pumps whereby the wrench shape is susceptible to the limited space thereof and does not impart any specific function whereby the action of the wrench will alter the configuration of the wrench jaws for better gripping when the wrench is subjected to excessive torque, nor does the shank of said wrench have a planar surface that is specified as the torqueing jaw for wrench heads, of different sizes, at both ends of the shank as does the present invention.

SUMMARY OF INVENTION

The universal object of the present invention is to address the problem of using typical open end wrenches whereby they slip off or round hexagonal fasteners when excessive torque is applied.

A unique feature of the present invention is provided a relief at the intersections of the arcuate surfaces and the planar surface of the shank.

Another feature of the invention is that the different size wrench heads at both ends of the shank utilize the same torqueing jaw that is the planar surface of the shank as illustrated in the description of the drawings.

Another advantageous characteristic of the invention is if the user unwittingly applies pressure on the shank in a straight line instead of rotational, the fastener is pulled into the mouth of the wrench jaws thus keeping the wrench from slipping off the fastener.

Still, another feature of the invention is the ease of engaging a hexagonal fastener with the wrench head by using the mutual torqueing jaw as a guide.

DETAILED DESCRIPTION OF THE PREFERRED EMBODIMENT

Figure 1:
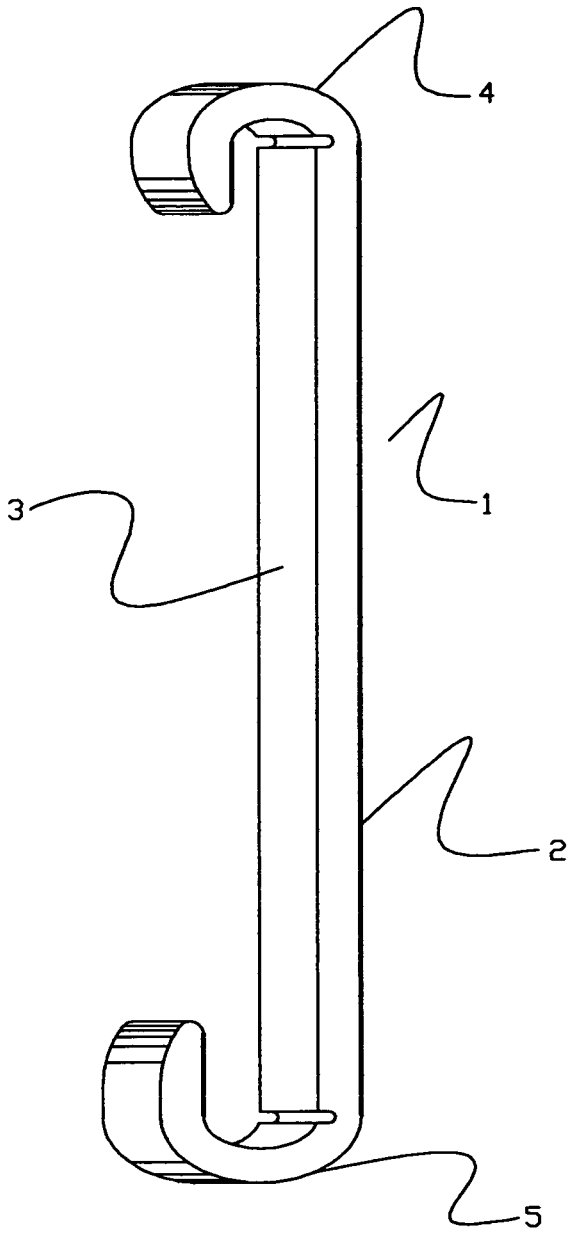
FIG. 1 is a perspective view of the invention showing wrench heads at both ends of the wrench.

The preferred embodiment of the present invention is defined by FIGS. 1 through 5. FIG. 1 is an isometric illustrating an open-end wrench 1, having a shank 2 with a smooth planar surface 3, whereby planar surface 3 is the mutual torqueing jaw of fastener specific wrench heads 4 and 5.

Figure 2A:
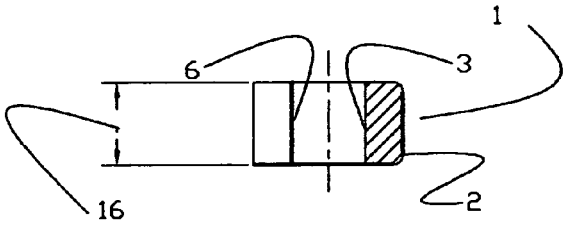
FIG. 2A is the section showing above normal thickness of invention.
Figure 2:
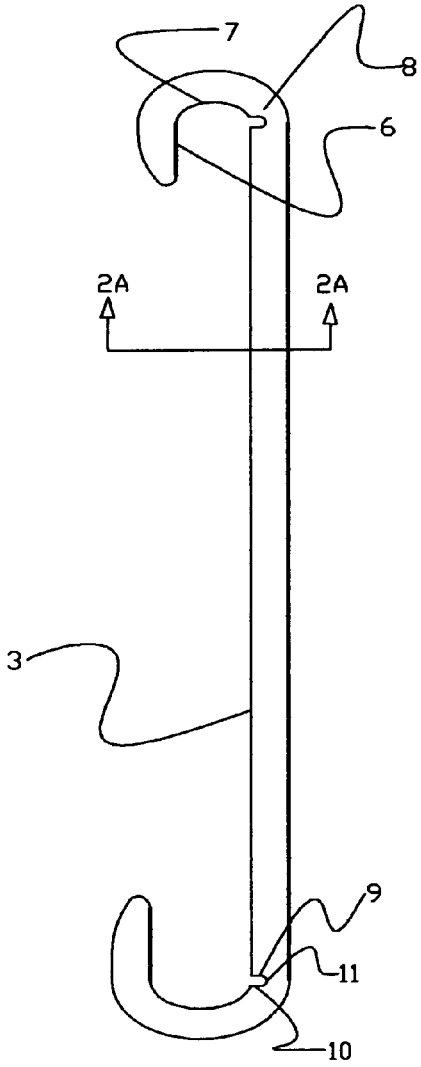
FIG. 2 is a view of the wrench showing the location of section 2A.
Figure 4:
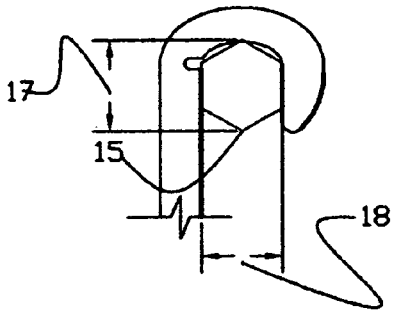
FIG. 4 is a partial view showing hexagonal fastener in place.

Shown in FIG. 2 is the location of section 2A, planer surface of backup jaw 6, arcuate surface 7 of wrench heads 4 and 5, and planar surfaces 9, 10 and arcuate surface 11 of relief 8.

Refereeing now to FIG. 2A showing above normal thickness 16 allowing for greater gripping surface to backup jaw 6 and torqueing jaw 3.

Figure 3:
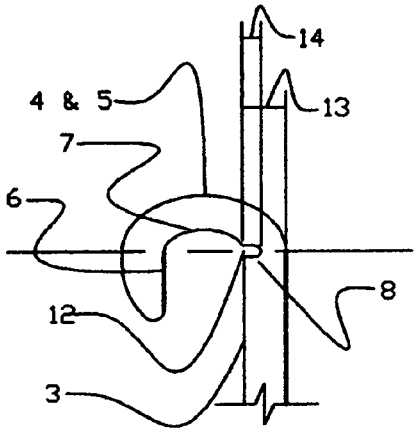
FIG. 3 is a partial view depicting the placement of the relief

FIG. 3, shows center line 12, passing through the intersection of planar torqueing jaw 3 and arcuate surface 7, locating the relief 8, having depth 14 which is slightly less than half thickness 13 thereby weakening the structure at this point and giving flexible quality to shank 2 when torque is applied, thus making surfaces 9, 10 of relief 8 and wrench head surfaces 6 and 3 non-planar respectively, therefore wedging the hexagonal fastener in the wrench jaws.

Figure 5:
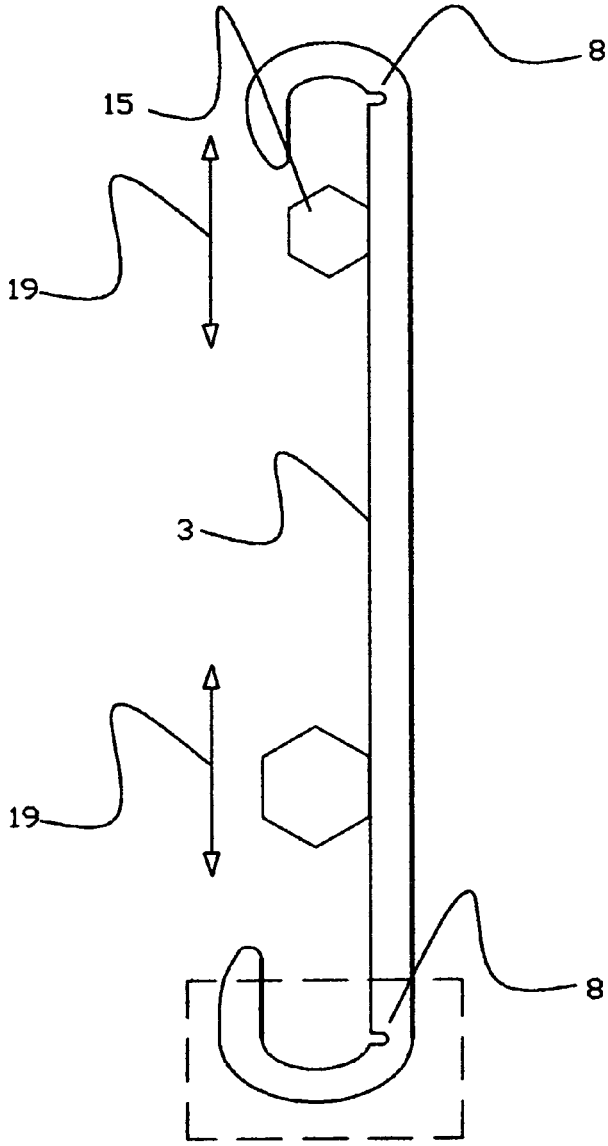
FIG. 5 shows working relationship of the wrench and hexagonal fastener and a dashed box giving reference to the wrench jaw and relief as having the properties of a simple fractal.

FIG. 5 indicates direction 19, as how to engage and disengage wrench heads 4 and 5 with hexagonal fastener 15, using the mutual torqueing jaw 3 as a guide, and a dashed box with reference to the wrench jaws and relief 8, having the properties of a simple fractals.

What is claimed is:

1. An open end wrench consisting of;

(a) a wrench having open end wrench heads at each end of a substantially long shank with both said heads facing in the same direction as the shank whereby said wrench heads have arcuate surfaces, back up jaws the same length as the across points of a given hexagonal fastener and a coplanar torqueing jaw that extends from its intersection of the arcuate surface of one wrench head to its intersection with the arcuate surface of the opposite wrench head, (b) the wrench heads having reliefs at the intersections of the arcuate surfaces and torqueing jaw and perpendicular to the planar torqueing jaw to a depth less than half the width of the shank.

* * * * *